US006756572B2

(12) United States Patent
Lee

(10) Patent No.: US 6,756,572 B2
(45) Date of Patent: Jun. 29, 2004

(54) THERMO-SENSITIVE HEATER AND HEATER DRIVING CIRCUIT

(76) Inventor: Myoung Jun Lee, 261 W. Riviera Ct., La Habra, CA (US) 90631

( * ) Notice: Subject to any disclaimer, the term of this patent is extended or adjusted under 35 U.S.C. 154(b) by 198 days.

(21) Appl. No.: 10/034,177

(22) Filed: Dec. 28, 2001

(65) Prior Publication Data

US 2002/0195442 A1 Dec. 26, 2002

(30) Foreign Application Priority Data

Jun. 9, 2001 (KR) ..... 2001-32324
Jul. 30, 2001 (KR) ..... 2001-45908

(51) Int. Cl.[7] ..... H05B 1/02

(52) U.S. Cl. ..... 219/505; 219/212; 219/497; 219/548; 219/552

(58) Field of Search ..... 219/212, 200, 219/209, 213, 482, 490, 491, 494, 497, 505, 548, 552, 553, 544, 549

(56) References Cited

U.S. PATENT DOCUMENTS 4,503,322 A * 3/1985 Kishimoto et al. ..... 219/505

FOREIGN PATENT DOCUMENTS

KR 97-64561 12/1997

* cited by examiner

*Primary Examiner*—Tu Ba Hoang
(74) *Attorney, Agent, or Firm*—Lee, Hong, Degerman, Kang & Schmadeka

(57) ABSTRACT

A thermo-sensitive heater and heater driving circuit are disclosed. The thermo-sensitive heater comprises a cord-shaped nylon thermistor that surrounds a heating element, such that the thermistor detects the temperature of the heating element and controls the driving current for a heating coil. Also, the present invention includes electro-magnetic shielding material, which is formed by winding an electric conductor around the outer surface of the nylon thermistor, or formed as a wire mesh. This shielding material is advantageous for discharging the electric field radiated from inside of the heater to an external electric field, thus safely eliminating harmful electric fields. Also, the present invention further provides a driving circuit for safely driving the heater, which includes a temperature controller or an overheating prevention circuit.

24 Claims, 9 Drawing Sheets

THERMO-SENSITIVE HEATER AND HEATER DRIVING CIRCUIT

CROSS REFERENCE TO RELATED ART

This application claims the benefit of Korean Patent Application Nos. 2001-32324 and 2001-45908, filed on Jun. 9, 2001 and Jul. 30, 2001, respectively, which are hereby incorporated by reference.

BACKGROUND OF THE INVENTION

1. Field of the Invention

The present invention relates in general to an electrical heater, and more particularly to a thermo-sensitive heater used in various kinds of mats or blankets.

2. Description of the Related Art

Conventional electric products such as electric mats and electric mattresses include one or more temperature sensors arranged in a laminated mat having a heater. A temperature controller in the heater detects a heating temperature of the heater by the temperature sensor, compares the detected temperature with a preset temperature, and controls caloric power of the heater. The conventional electric product, designed to control the temperature of its heater as described above, has a problem that the price of the product is increased due to the use of the temperature sensors and sensor connecting wires. Such a conventional electric product also has a problem that the product does not meet the electromagnetic wave safety standards because electromagnetic waves are undesirably radiated from the lead wires extending between the sensors and the temperature controller.

The term "heating element", "heating wire" or "heater" is intended to mean a cord-shaped heating material having flexibility, and coated with synthetic resins for protection, for being arranged in a heating product such as an electric mat, an electric blanket, an electric cushion, an electric bed, socks, and etc, and being used to perform the heating function of such products.

According to the prior art, a generally used non-magnetic heating wire is disclosed in Korean Utility Laid-open Publication No.97-64561. This electromagnetic wave attenuation heater has an insulation layer interposed between inner and outer coiled heating wires, with the ends of the wires connected to each other such that the directions of currents flowing in the conducting wires within a heating element are opposite to each other, and thereby the electronic waves from the wires can be offset. Consequently, the directions of circular magnetic fields surrounding the heating coils are also opposite to each other, and thereby the intensity of magnetic field from the heating coils can be decreased. However, even in a case of using the non-magnetic heating wire, there are generated electric fields, which fatigue the nervous system of a body. It is also common knowledge that magnetic fields prevent a person from sleeping soundly by affecting brain waves. Therefore, a method of eliminating the electric field in heaters must be devised.

Further, an electromagnetic wave removing apparatus has been proposed and used for discharging electromagnetic waves to the ground. An electromagnetic wave discharging apparatus is applied to various kinds of electric mats, as well as electric products having the electromagnetic wave attenuation heater. In the construction of such electromagnetic wave discharging apparatuses, an electromagnetic wave shielding element, such as a copper net and etc., is installed in an electric product such that the shielding element surrounds the heater inside the electric product. In such a case, the copper net used as the shielding element is connected to the ground. The installation of a copper net in an electric product for removing the electromagnetic waves from the product is problematic in that it wastes materials, complicates the production process, and increases the weight and cost of the product, thus deteriorating the competitive power and design flexibility of the product.

For the foregoing reasons, there is a need for a heater that reduces electromagnetic radiation without requiring increased amount of materials and cost of production.

SUMMARY OF THE INVENTION

Accordingly, the present invention is directed to a thermo-sensitive heater and heating circuit that substantially obviates one or more of the problems due to limitations and disadvantages of the related art.

It is an object of the present invention to provide a thermo-sensitive heater having both a nylon thermistor and an electric field shielding coil within a cord-shaped heater and operates such that its temperature controller detects the temperature of the heating element, and controls the driving current for a heating coil.

It is another object of the present invention to provide a thermo-sensitive heater for controlling a heater driving current without a separate temperature sensor.

It is still another object of the present invention to provide a driving circuit for safely driving the heater.

It is still another object of the present invention to provide a driving circuit having an overheating prevention circuit.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a thermo-sensitive heater comprises a nylon thermistor arranged on a middle layer between a cord-shaped heating element and an electrical insulation coating layer for detecting a temperature of the heating element, and having a negative temperature characteristic. A current supplying terminal is connected to one of inner and outer surfaces of the nylon thermistor, and a temperature detecting terminal is connected to the other of the inner and outer surfaces of the nylon thermistor for controlling a driving current for the heating element by a temperature controller.

According to one aspect of the preferred embodiment of the present invention, the nylon thermistor is tubular and is formed on an outer surface of the cord-shaped heating element through an extrusion forming process and an inner side of the thermistor is connected to a heating coil which is also used in part as a temperature detecting terminal.

According to another aspect of the preferred embodiment, the thermo-sensitive heater employs a driving circuit.

In an alternative embodiment of the present invention, a thermo-sensitive heater having a heating element inside it, and having a coating layer with electric insulating and waterproofing means on its outside, comprises a cord-shaped nylon layer, as a thermo-sensitive device, that surrounds an entire heating element, a first electrode contacted with an inner surface of the nylon layer, a second electrode connected to an outer surface of the nylon layer, an electric insulation layer for surrounding the entire surfaces of the cord-shaped nylon layer, and a first shielding coil wound around entire surfaces of the electric insulation layer.

According to one aspect of the alternative embodiment, the first electrode is used as a heating coil and the second electrode is used as a second shielding coil where the heating element is a non-magnetic heating element.

According to another aspect of the alternative embodiment, the thermo-sensitive heater employs a driving circuit.

According to another aspect of the alternative embodiment, resistors within the circuit are arranged to heat a temperature fuse.

In another alternative embodiment of the present invention, wire meshes are used as electrodes and/or electric fields shields.

It is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION

With reference to the drawings, and in particular to FIGS. 1–9 thereof, a thermo-sensitive heater and driving circuit embodying the principles and concepts of the present invention will be described.

Figure 1:
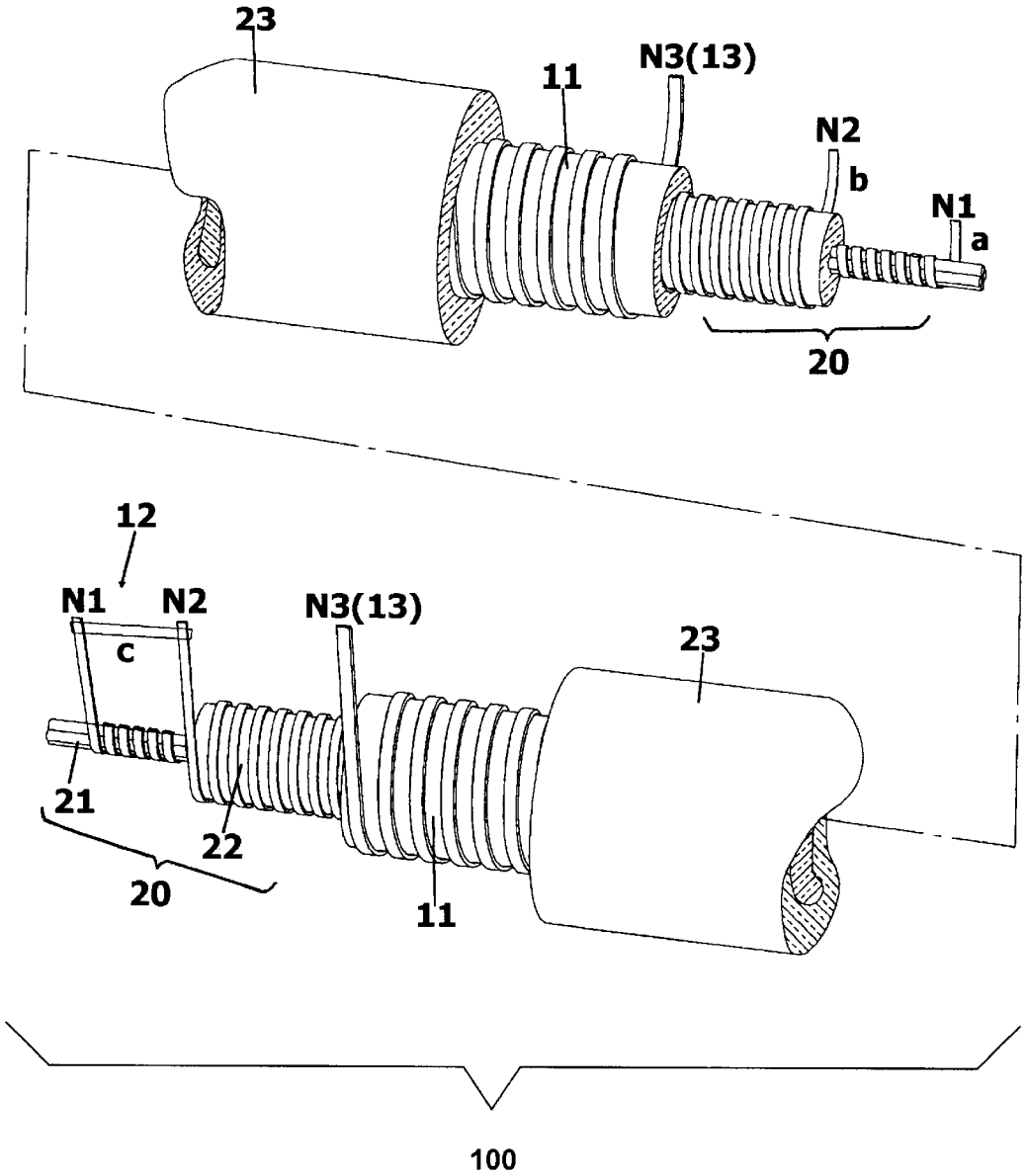
FIG. 1 illustrates a partly broken perspective view showing a thermo-sensitive heater according to a first embodiment of the present invention.
Figure 2:
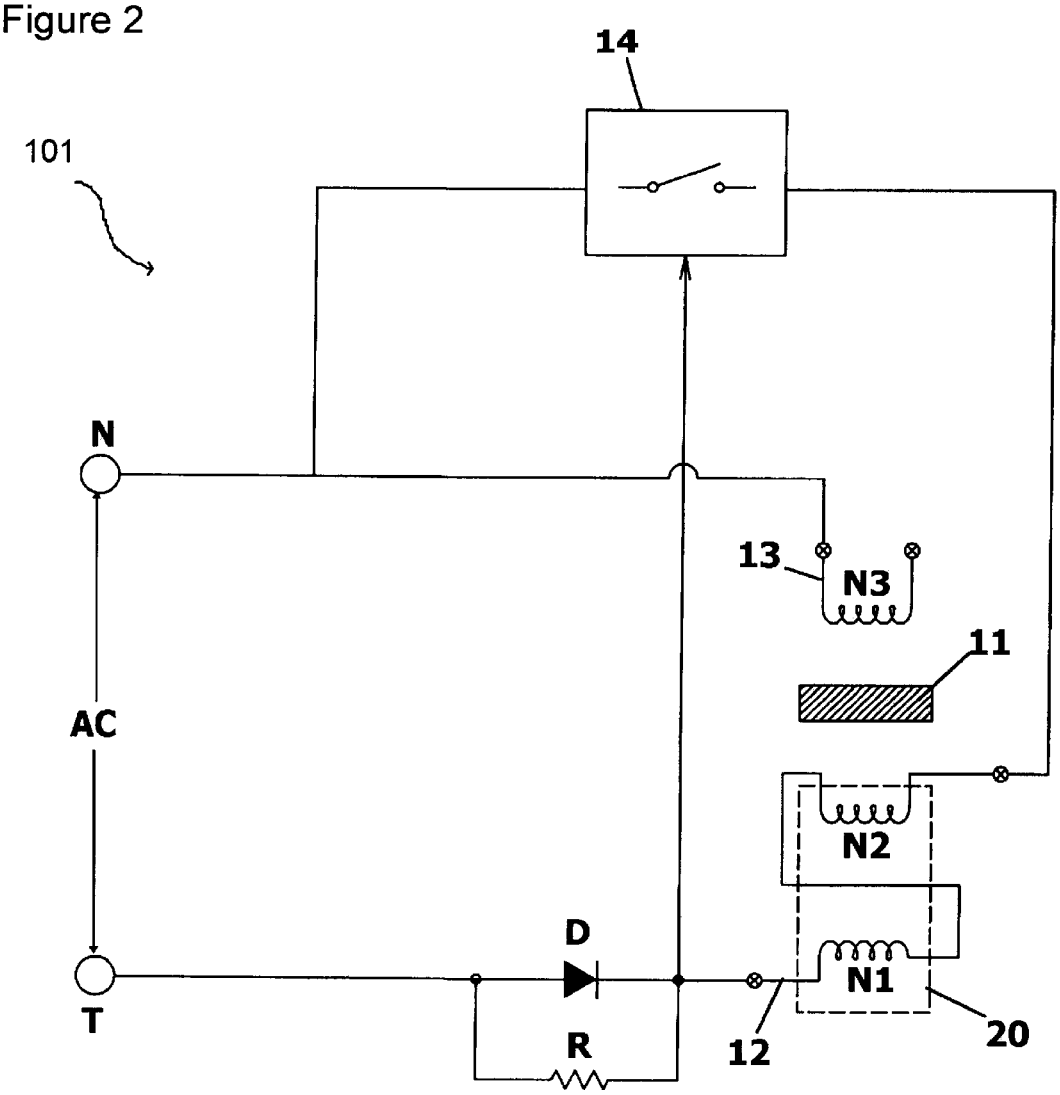
FIG. 2 illustrates a circuit diagram of a heater driving circuit according to a first embodiment of the present invention.

FIG. 1 is a partly broken perspective view showing a thermo-sensitive heater 100 according to a first embodiment of the present invention. FIG. 2 is a view showing a circuit diagram of a heater driving circuit 101. Referring to FIG. 1 and FIG. 2, the heater 100 according to the first embodiment of this invention comprises a nylon thermistor 11, a current supplying terminal 13 and a temperature detecting terminal 12. The nylon thermistor 11 is arranged on a middle layer between a cord-shaped heating element 20 and an electric insulation coating 23 for detecting a temperature of the heating element 20. The current supplying terminal 13 is connected to the outer surfaces of the nylon thermistor 11, and supplies a current during temperature detection. The temperature detecting terminal 12 is connected to the other end of the thermistor's inner surface, and detects a heating temperature of the heating element 20 when a temperature controller 14 controls the driving current for the heating element 20.

Preferred specifications of the heater 100, which is shown in FIG. 1 and FIG. 2, are provided in Table 1, below.

TABLE 1

| | |
|---|---|
| covered layer 23 | PVC with a width of approximately 0.7 mm (extrusion forming) |
| nylon thermistor 11 | nylon resin with a width of approximately 0.45 mm (extrusion forming) |
| shielding coil N3 | rolled copper wire formed by compressing a copper wire with a diameter of approximately 0.23 mm to a width of approximately 0.1 mm |
| electric insulating resin layer 22 | Silicon rubber with a width of approximately 0.45 mm (extrusion forming) |
| heating coil N2 | rolled copper wire formed by compressing a copper wire with a diameter of approximately 0.18 mm to a width of approximately 0.1 mm |
| center support structure 21 | polyester filament yarn with a diameter of approximately 0.6 mm (2000 denier) |
| heating coil N1 | rolled copper wire formed by compressing a copper wire with diameter of approximately 0.18 mm to a width of approximately 0.1 mm |

As described above, the heater 100 includes a nylon thermistor 11 for temperature detecting on the cord-shaped heating element 20, such that the heater provides heating temperature information of the heating element 20 to the temperature controller 14 without using a separate temperature sensor.

Specifically, the thermistor 11, formed on the outer surface of the cord-shaped heating element 20 through an extrusion forming process, is a tubular nylon thermistor of which the inner surface is connected to a heating element coil N2. The thermistor 11 is formed as a part of the cord-shaped heating element 20, and the temperature controller 14 measures the temperature of the heating element 20 using the thermistor 11.

Referring to FIG. 2, an alternating current (AC) supplying voltage is connected to a driving current input terminal T and neutral terminal N. A diode D is arranged between the heating coil N1 and the terminal T. During a heating cycle with a positive AC voltage applied to the terminal T, the positive voltage is applied to the heating coils N1, N2 in addition to the anode of an SCR (Silicon Controlled Rectifier, not shown) through the terminal T, thus driving the heating coils N1, N2 and preparing for a trigger operation of the SCR. On the other hand, during a temperature detecting cycle with the positive AC voltage applied to the terminal N, the positive voltage is applied to the nylon thermistor 11 through the terminal N and the terminal 13 (or a shielding coil N3).

The heating coil N2 is connected to the inner surface of the tubular type nylon thermistor 11. As a result of this, the heating coils N1, N2 connected to each other in series are used as the temperature detecting terminal 12 during the temperature detecting cycle.

The shielding coil N3 is wound around the outer surface of the nylon thermistor 11. During the heating cycle with the driving current applied to the heating element 20, the shielding coil N3 absorbs the electromagnetic waves radiated from the heating element 20, and radiates the absorbed electromagnetic wave to the neutral terminal N connected to the ground.

A heating resistor R is preferably arranged in parallel to the diode D in order to induce a temperature voltage left on the inner surface of the nylon thermistor 11 to the terminal 12 or the heating coils N2 and N1 when a positive voltage is applied to the tubular nylon thermistor 11 through the terminal N and the terminal 13.

The temperature controller 14 detects the temperature voltage of the heating element 20 at the temperature detecting terminal 12 during a temperature detecting cycle, and controls the driving current for the heating coils N1 and N2.

Figure 3:
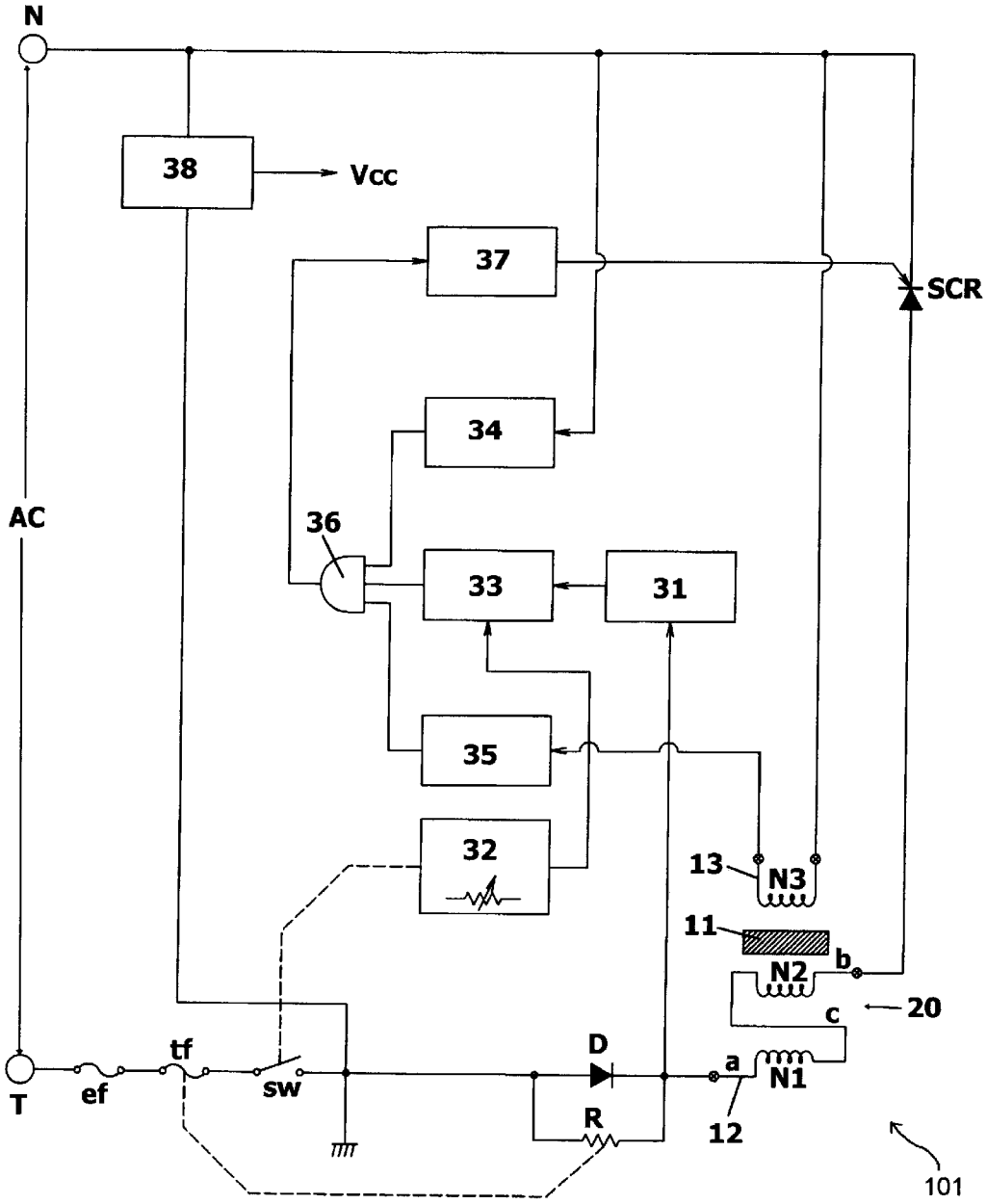
FIG. 3 illustrates a detailed circuit diagram of a heater driving circuit according to a first embodiment of the present invention.

FIG. 3 is a view showing the driving circuit 101 of this invention in detail. Referring to FIG. 3, the temperature controller 14 according to first embodiment will be described in detail.

As shown in the drawing, an SCR is arranged between the heating coil N2 and the terminal N so as to switch on/off the driving current for the heating coils N1 and N2, which flows through the terminal T.

During a temperature detecting cycle, a temperature detector 31 detects a temperature voltage inducted to the temperature detecting terminal 12 arranged between the heating resistor R and the heating coil N1, amplifies the detected voltage, and outputs the amplified voltage to a temperature comparator 33 in a next heating cycle.

Referring to FIG. 3, a temperature setting unit 32 is installed to set a heating temperature of the heating element 20. This temperature setting unit 32 is realized as a variable resistor receiving a constant voltage Vcc from a circuit voltage supplying unit 38. Further, the temperature setting unit 32 is arranged to operate in conjunction with a switch "sw" used for switching on/off the driving current for the heating element.

The temperature comparator 33 compares a temperature (or voltage) detected by a temperature detector 31 during the heating cycle with the preset temperature(or voltage), outputs a "high" signal if the detected temperature is lower than the preset temperature and outputs a "low" signal if the detected temperature is higher than the preset temperature.

For power saving, a zero detector 34 is installed in the temperature controller 14. The zero detector 34 detects a voltage at the terminal N, generates a "high" signal for a predetermined period of time on the basis of the time when the voltage at the terminal N is 0 V—in detail, for a time of 1/20 of one AC cycle—and outputs a "low" signal for the remaining time of the AC cycle.

Further, a disconnection detector 35 for the shielding coil N3 is arranged in order to cut off the driving current for the heating element 20 automatically, when the temperature rises excessively due to a disconnection of the shielding coil N3. The disconnection detector 35 is connected to one end of the shielding coil N3 of which the other end is connected to the terminal N, such that the disconnection detector 35 generates a "high" signal if the shielding coil N3 is not disconnected, and generates a "low" signal if the shielding coil N3 is disconnected.

An AND gate 36 is installed to logically combine the output signals from the zero detector 34, the temperature comparator 33 and the disconnection detector 35. The AND gate 36 outputs a driving signal for the heating coils N1, N2 to a driving unit 37 when all of the output signals from the zero detector 34, the temperature comparator 33, and the disconnection detector 35 are "high".

The driving unit 37 generates a driving signal of the SCR as a switching device for switching the heating coils N1, N2 if the AND gate 36 outputs a "high" signal.

The temperature controller 14 as configured above is operated as follows. During the temperature detecting cycle with a positive voltage applied to the terminal N and a negative voltage applied to the terminal T, the negative voltage is applied to the anode of the SCR and the positive voltage is applied to the cathode of the SCR. Thus, the SCR is turned off to inactivate the heating coils N1, N2. The positive voltage applied to the terminal N is supplied to a temperature detecting current circuit, wherein the temperature detecting current circuit includes the current supplying terminal 13, the nylon thermistor 11, the heating coils N1, N2, the heating resistor R and the terminal T. A current detected by the temperature detecting current circuit is in inverse proportion to the resistance of the nylon thermistor 11 and in proportion to the temperature, and a voltage proportional to the current applied to the terminal 13 is taken at opposite sides of the heating resistor R.

During the heating cycle with a positive voltage applied to the terminal T and a negative voltage applied to the terminal N, the SCR is turned on and thus, a current of the diode D flows in a forward direction and the positive voltage at the terminal T is applied through the diode D to the heating coils N1, N2 not to the resistor R.

However, even during the heating cycle, in a specific condition that the predetermined period of time set by the zero detector 34 is deviated from the restricted time, or the detected temperature is over the preset temperature, or the output of the AND gate 36 is "low" due to a detection of disconnection of the current supplying terminal 13, the SCR is turned off, thus preventing the heating coils N1, N2 from being driven.

An operation of preventing an excessive rise of the temperature of this invention is described as follows. If the nylon thermistor 11 is fused or damaged for any reason and then the shielding coil N3 used as the current supplying terminal 13 is connected to the heating coil N2, the positive voltage at the terminal N is supplied to the heating coils N1, N2 directly. In this case, a high current flows through a circuit, which starts from the terminal N and ends at the terminal T, via the shielding coil N3, the heating coils N2, N1 and the heating resistor R. The resistor R is thus heated to a high temperature and then, the temperature fuse "tf" connected to the resistor R is cut.

Further, when the SCR is shorted, the current flows through the terminal N, the SCR, the heating coil N2, the heating coil N1 and the resistor R. In this case, the heating resistor R is heated, and thus, the fuse "tf" is cut and the temperature controller 14 shown in FIG. 3 maintains a safe operation of the heater.

Figure 4:
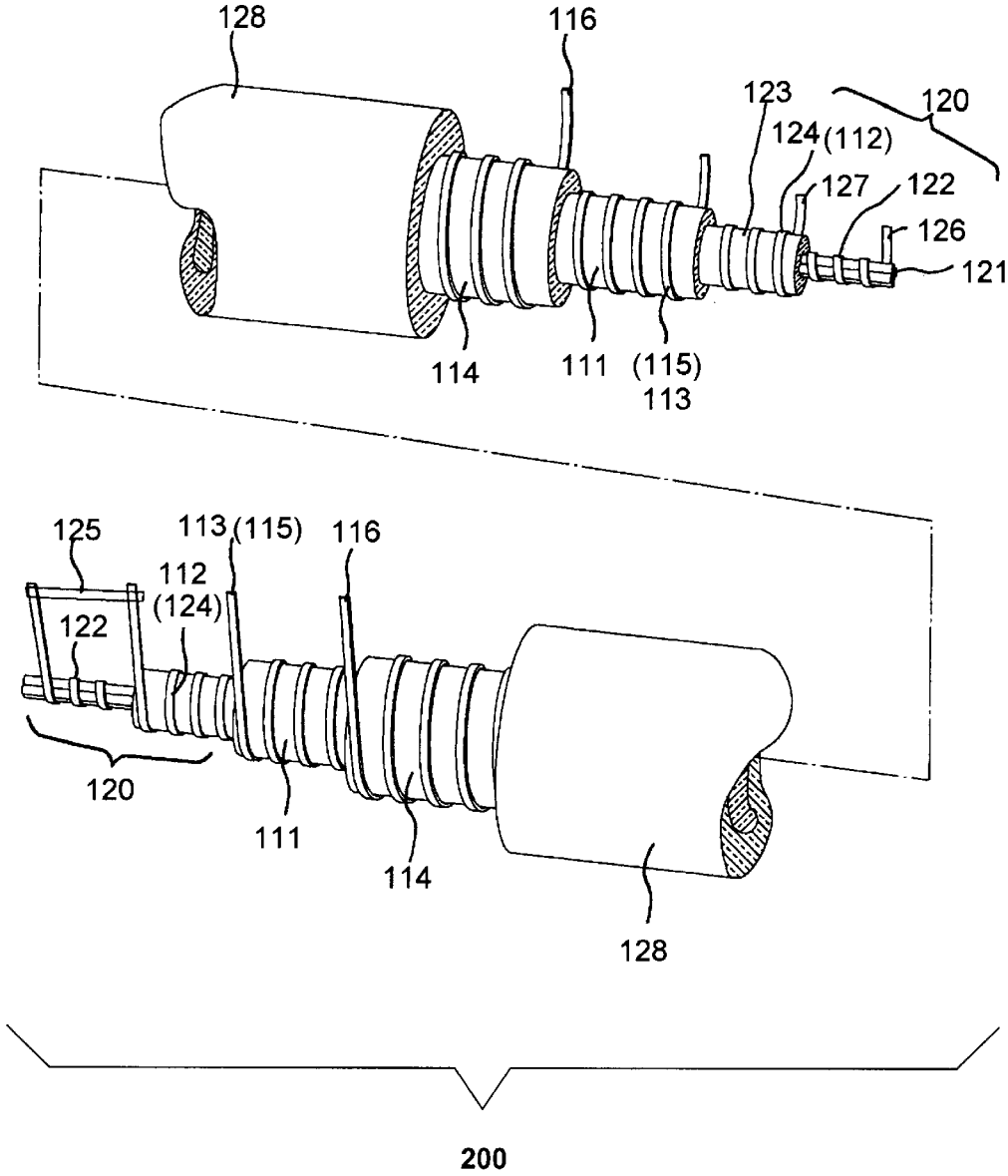
FIG. 4 illustrates a partly broken perspective view showing a thermo-sensitive heater according to a second embodiment of the present invention.
Figure 5:
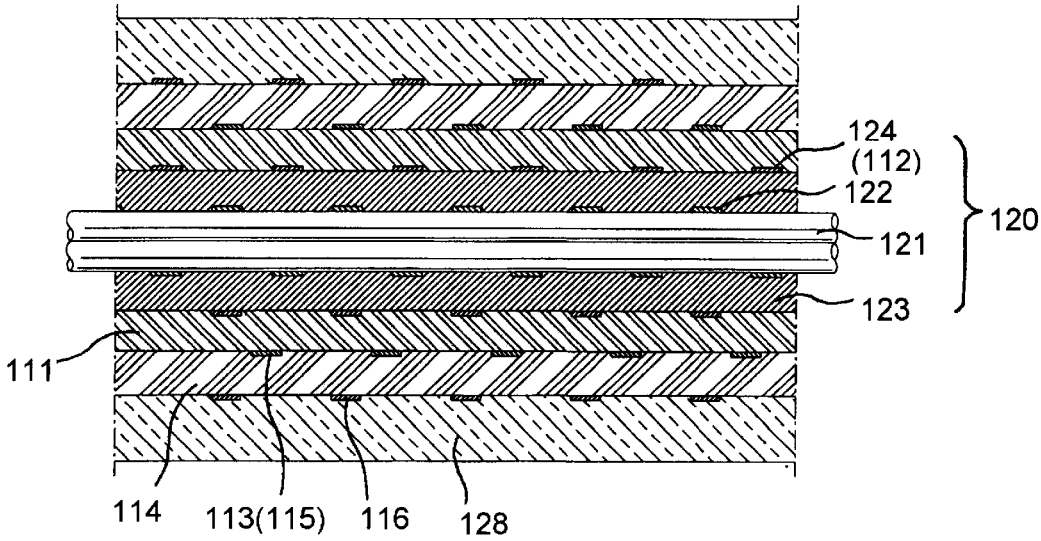
FIG. 5 illustrates a partly broken sectional view showing a thermo-sensitive heater according to a second embodiment of the present invention.

FIG. 4 is a partly broken perspective view showing a thermo-sensitive heater 200 according to a second embodiment of the present invention, and FIG. 5 is a cross-sectional view showing this embodiment of the present invention. Referring to FIG. 4 and FIG. 5, the construction and operation of the heater 200 are described in detail.

The heater 200 comprises a nylon layer 111, a first electrode 112, a second electrode 113, a second electric insulation layer 114, a first shielding coil 116, and a coating layer 128. Alternative to the nylon layer 111, other suitable insulating layer may also be used.

The nylon layer 111 in the manner of a cord is a thermo-sensitive device arranged to surround an entire heating element 120 in order to get an electric resistance value of a thermistor corresponding to a temperature variation of the heating element 120.

The first electrode 112 is contacted with an inner surface of the nylon layer 111 for applying a temperature measuring current to the nylon layer 111, and is used as a heating element of the heating element 120. The second electrode 113 for temperature detection is connected to an outer surface of the nylon layer 111 for detecting an electric resistance value of the nylon layer 111, which is varied according to the temperature variation of the heating element 120.

The second electric insulation layer 114 surrounds the entire surfaces of the cord-shaped nylon layer 111. The first shielding coil 116 is wound around the entire surface of the second electric insulation layer 114 in order to discharge an electric field radiated from the heating element 120 to an external electric field. The coating layer 128 with electric insulating and waterproofing means surrounds the first shielding coil 116.

Referring to FIGS. 4 and 5, the heater 200 as a non-magnetic field emitting heating element is described in detail. The non-magnetic heating element 200 comprises an electric insulation core wire 121, a first heating coil 122, a first electric insulation layer 123, a second heating coil 124, an end connection part 125, and driving current connection terminals 126, 127.

The first heating coil 122 is wound around the entire surfaces of the core wire 121. The first electric insulation layer 123 is arranged in outer surface of the first heating coil 122. The second heating coil 124 is wound around the entire surfaces of the first electric insulation layer 123. The end connection part 125 is arranged to connect each one end of the heating coils 122, 124 to each other. The driving current connection terminals 126, 127 are arranged to apply the driving current to the other ends of the heating coil 122, 124 connected to each other.

In this case, the heating coils 122, 124 are copper wires without an insulation coating.

When the driving current flows into the driving current connection terminals 126, 127 of the non-magnetic heating element, the directions of currents flowing through the heating coils 122, 124 are opposite to each other. Thereby, the directions of circular magnetic fields formed around the heating coils 122, 124 are opposite to each other, thus decreasing the intensity of the total magnetic field from the heating element.

The thermo-sensitive heater applied to the non-magnetic heating element of this embodiment of the present invention comprises a nylon layer 111, a first electrode 112, and a second electrode 113. The nylon layer 111 is arranged to surround the entire surfaces of the second heating coil 124 in the manner of a cord. The first electrode 112 is arranged to apply the temperature detecting current to the entire surfaces of an inner circle of the nylon layer 111, and is used as the second heating coil 124. The second electrode 113 is wound around the entire outer surfaces of the nylon layer 111 for detecting the electric resistance variation according to the temperature variation.

The first electrode 112 is driven as a heating coil 124, and is connected to the entire inner surfaces of the nylon layer 111 in the shape of a coil and then operates as an electrode for applying the temperature detecting current to the nylon layer 111.

Further, the electrode 113 for temperature detection is wound around the outer surface of the cord-shaped nylon layer 111 in the shape of a coil, thus enabling the temperature to be detected at the entire surface of the nylon layer 111. Additionally, the electrode 113 is used as the second shielding coil 115 for radiating the electric field from the heating element to the external electric field due to its construction of surrounding the entire surfaces of the nylon layer 111.

The nylon layer 111 as a thermo-sensitive device, arranged on the heating element 120 has a negative temperature characteristic of decreasing the electric resistance value as the temperature rises.

Consequently, in order to drive the heater, a heater driving circuit measures the temperature voltages at both the first electrode 112 and the second electrode 113, processes an operation requiring with the measured voltages, and controls the heating temperature of the heater.

If being used as a second shielding coil 115, the second electrode 113 is connected to the external electric field, such that the electric field radiated from the heating element can be discharged.

The first heating coil 116 always surrounds the heating element 120 in the shape of a spiral coil at the outer surface of the electric insulation layer 114. In this case, the first shielding coil 116 is connected to an external electric field such as a ground or a neutral terminal of an AC power supply, such that the electric field radiated from the heating element can be charged to the external electric field.

Moreover, if the second electrode 113 is connected to the external electric field for using the second electrode 113 as the second shielding coil 115, a dual-spiral shielding coil shields the electric field of the heating element to discharge it to the external electric field, thus enabling the electric field radiated from the heating element to be more perfectly eliminated.

Preferred specifications of this embodiment of the present invention, which is shown in FIGS. 4 and 5, are given in Table 1, below.

TABLE 1

| | |
|---|---|
| 121 core wire | glass fiber wire with a diameter of approximately 0.5 mm (1500 denier) |
| 122 first heating coil | rolled copper wire formed by compressing a copper wire with a diameter of approximately 0.23 mm to a width of approximately 0.1 mm |
| 123 first electric insulation layer | silicon rubber with a width of approximately 0.35 mm (tubular extrusion forming) |
| 124 second heating coil | rolled copper wire formed by compressing a copper wire with a diameter of approximately 0.23 mm to a width of approximately 0.1 mm |
| 111 nylon layer | nylon resin with a width of approximately 0.3 mm (tubular extrusion forming) |
| 112 first electrode | rolled copper wire formed by compressing a copper wire with a diameter of approximately 0.23 mm to a width of approximately 0.1 mm |
| 113 second electrode | rolled copper wire formed by compressing a copper wire with a diameter of approximately 0.23 mm to a width of approximately 0.1 mm |
| 114 second electric insulation layer | silicon rubber with a width of approximately 0.35 mm (tubular extrusion forming) |
| 116 first shielding coil | rolled copper wire formed by compressing a copper wire with a diameter of approximately 0.23 mm to a width of approximately 0.1 mm |
| 128 coating layer | PVC with a width of approximately 0.7 mm (tubular extrusion forming) |

Figure 6:
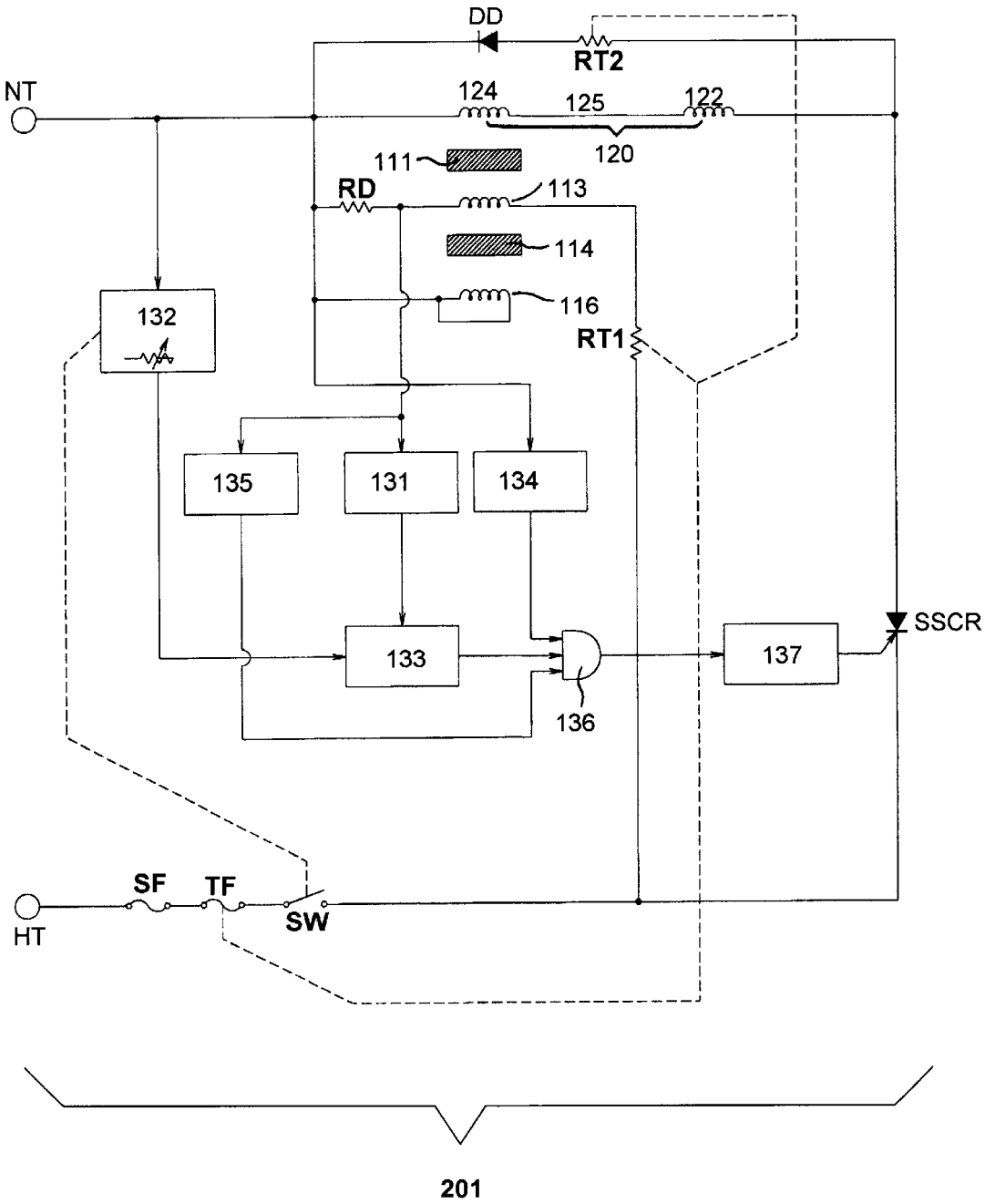
FIG. 6 illustrates a circuit diagram of a heater driving circuit according to a second embodiment of the present invention.

FIG. 6 is a circuit diagram of a heater driving circuit 201 for driving and controlling the heater of this embodiment of the present invention.

The heater driving circuit 201 includes a switching SSCR, a temperature detecting resistor RT1, a temperature detector 131, a temperature setting unit 132, a comparator 133, a zero detector 134, a disconnection detector 135, an AND gate 136, an amplifier 137, a diode DD, and a heating resistor RT2.

Referring to FIG. 6, the switching SSCR is arranged in serial to the heating element 120 so as to switch on/off the driving current applied to the heating element 120 during a driving cycle with a positive voltage applied to a neutral terminal NT of AC power supply.

The temperature detecting resistor RT1 is arranged to apply the positive voltage to the second electrode 113, bypass the positive voltage through the nylon layer 111 and the first electrode 112, and output a voltage difference between both ends of the resistor RT1 as a temperature voltage, during a temperature detecting cycle when a positive voltage is applied to the hot terminal HT and the SSCR is turned off.

The temperature detector 131 detects and amplifies the temperature voltage induced at the second electrode 113 through the second electrode 113 during the temperature detecting cycle, and outputs the detected temperature voltage to the comparator 133 during the driving cycle.

The temperature setting unit 132 sets a driving temperature of the heating element by a variable resistor, and outputs the set temperature as a temperature setting voltage corresponding to the set temperature to the comparator 133.

The comparator 133 compares the detected temperature voltage with the temperature setting voltage, and outputs a logic "high" signal if the detected temperature voltage is lower than the temperature setting voltage while outputting a "low" signal if the detected temperature voltage is higher than the temperature setting voltage, during the driving cycle.

The zero detector 134 detects a voltage at the neutral terminal NT, and sets a trigger point of time of the SSCR—for example, a time of 1/20 of one AC cycle—around 0 V.

The disconnection detector 135 detects a disconnection of the second electrode 113, and outputs the detected result to the AND gate 136.

The AND gate 136 logically combines the output signals from the zero detector 134, the temperature comparator 133, and the disconnection detector 135, and outputs the combined signal.

The amplifier 137 amplifies the output signal of the AND gate 136, and provides the amplified signal to a gate of the SSCR as a SSCR driving signal.

The diode DD is arranged to be connected to both ends of the heating element 120 in forward direction to a positive voltage applied to the hot terminal HT for preventing the driving current from flowing through the heating element 120 by the positive voltage of the hot terminal HT if the SSCR is damaged.

The heating resistor RT2 is arranged to cut the temperature fuse TF when a current flows in the forward direction through the diode DD.

Referring to FIG. 6, the SF is a current fuse, SW is a power supply on/off switch, and RD is a disconnection detecting resistor. Further, the heating resistors RT2 and the temperature detecting resistor RT1 are arranged to heat the temperature fuse TF.

Hereinafter, the operation of the heater driving circuit of this embodiment of the present invention is described in detail referring to FIG. 6.

First, when the driving temperature of the heating element is set by the temperature setting unit 132 and the switch SW is turned on while the positive voltage is applied to the neutral terminal NT, if the SSCR is turned on, the heating element 200 is activated, while if the SSCR is turned off, the heating element 120 is inactivated. On the other hand, while the positive voltage is applied to the hot terminal HT, a reverse voltage is applied to the SSCR, thus stopping the flow of driving current through the heating element 120 to inactivate it.

When the AND gate 136 outputs a logic "high" signal, and the amplifier 137 amplifies the output signal of the AND gate 136, and then the logic "high" signal from the amplifier 137 is applied to a gate of the SSCR, the SSCR is turned on.

Here, the conditions of outputting a "high" signal by the AND gate 136 are described. First, the zero detector 134 outputs a logic "high" signal during the driving cycle, however, a logic "low" signal not during the driving cycle. Then, the trigger point of time of the SSCR is around 0 V of the AC power supply.

Further, the comparator 133 compares the detected temperature with the set temperature, outputs a logic "high" signal if the detected temperature is lower than the set temperature while outputting a "low" signal if the detected temperature is higher than the set temperature.

The disconnection detector 135 checks a state of the second electrode 113 for temperature detecting, outputs a logic "high" signal if the second electrode 113 is in normal state, while outputting a "low" signal if disconnection of the electrode 113 is detected.

If the SSCR is damaged, the positive voltage of the hot terminal HT is applied to the heating element 120. However, the positive current according to the positive voltage is applied to the diode DD as a forward directional voltage while heating the heating resistor RT2. Then, the forward directional voltage is bypassed to the neutral terminal NT, thereby preventing the heating element 120 from overheating.

If the positive voltage of the hot terminal HT is applied to the heating resistor RT2 and the resistor RT2 is heated, the temperature fuse TF is cut and the driving circuit is powered off.

In case that the nylon layer 111 is melted, or the second electrode 113 is electrically connected to the second heating coil 124 by any reasons, the positive current of the hot terminal HT flows into the neutral terminal NT through the second electrode 113 and the heating coil 124, thus overheating the heater. In this case, the resistor RT1 used as a temperature detecting resistor is heated and the fuse TF is cut, and thus preventing the heater from being overheated.

Further, the first or second shielding coil 116 or 115 is connected to the neutral terminal NT, thereby enabling the electric field radiated from the heating element 120 to be eliminated by bypassing it.

Figure 7:
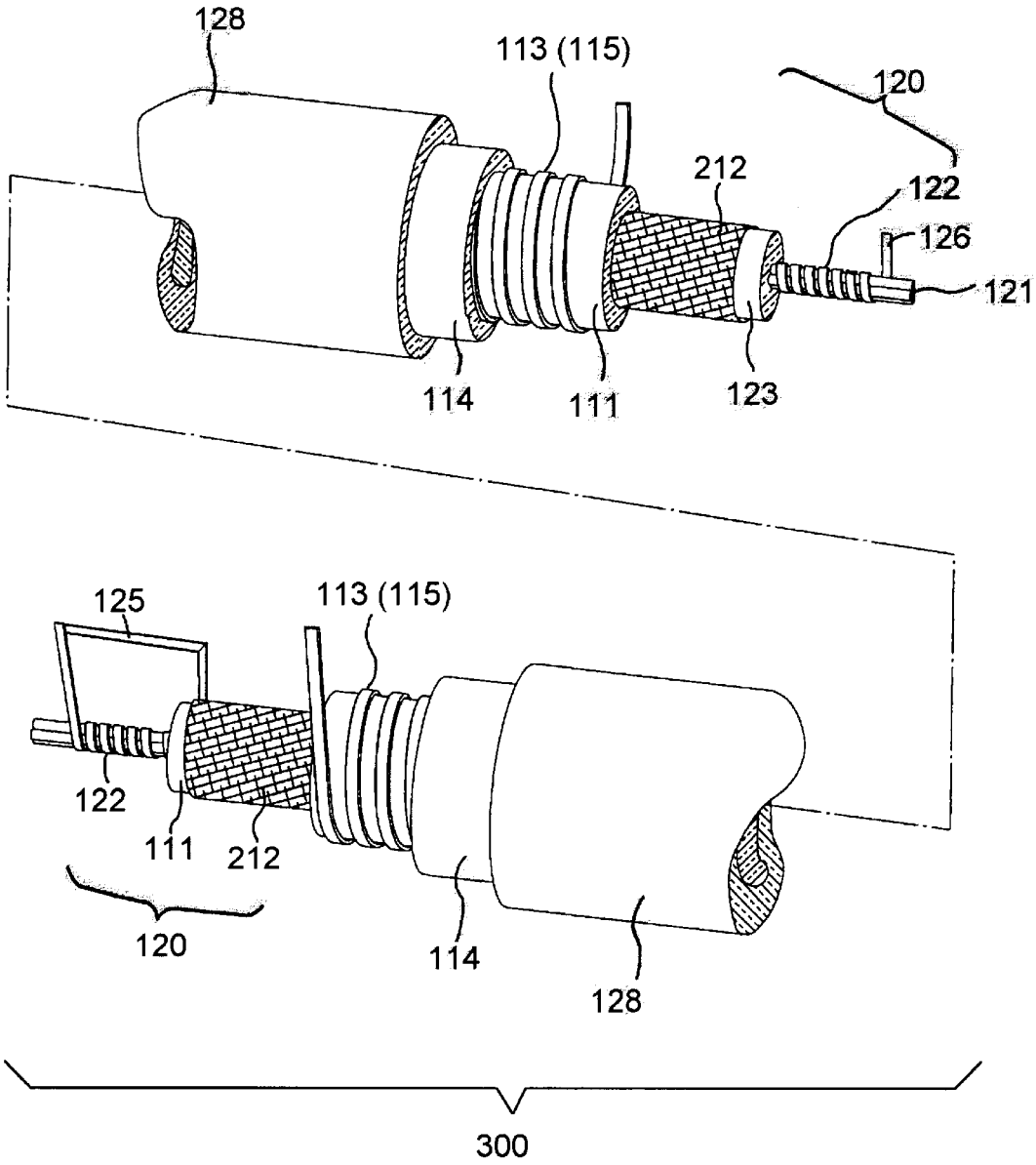
FIG. 7 illustrates a partly broken perspective view showing a thermo-sensitive heater according to a third embodiment of the present invention.

FIG. 7 is a partly broken perspective view showing a thermo-sensitive heater 300 according to a third embodiment of the present invention. The heating coil 124, which is also the first electrode 112, in FIG. 4 is replaced by a wire mesh 212, as shown in FIG. 7. Consequently, the wire mesh 212, which acts as a heating coil and as a first electrode, eliminates the need for a first shielding coil (as depicted by element 116 in FIG. 4) located on the outer surface of the second electric insulation layer 114 because of its ability to effectively reduce an electric field radiated from the heating element 120 to an external electric field. The end connection part 125 is arranged to connect each one end of the heating coil 122 to the wire mesh 212.

Figure 8:
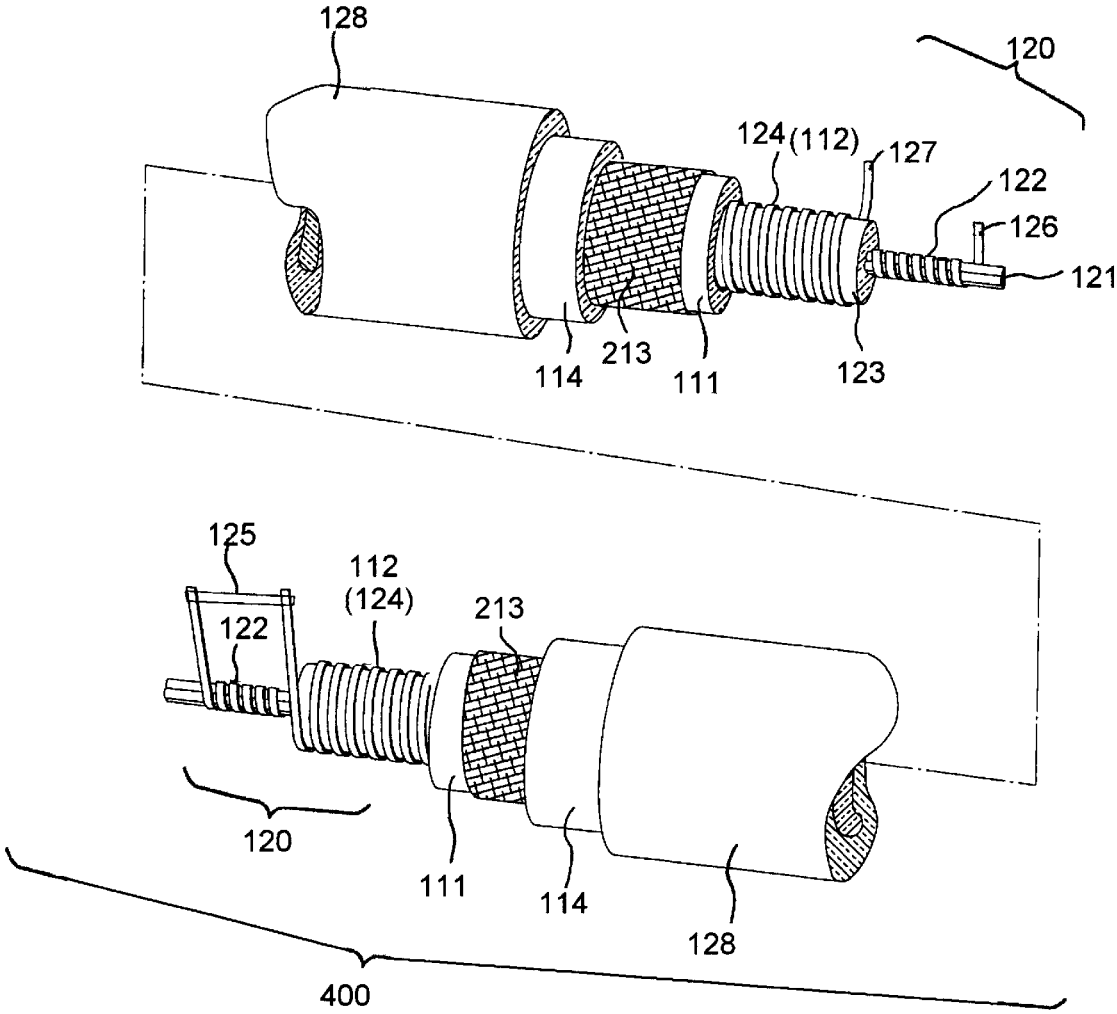
FIG. 8 illustrates a partly broken perspective view showing a thermo-sensitive heater according to a fourth embodiment of the present invention.

FIG. 8 is a partly broken perspective view showing a thermo-sensitive heater 400 according to a fourth embodiment of the present invention. The shielding coil 115, which is also a second electrode 113, in FIG. 4 is replaced by a wire mesh 213, as shown FIG. 8. Similar to the embodiment described by FIG. 7, the wire mesh 213, which acts as a shielding coil and a second electrode, eliminates the need for a first shielding coil (as depicted by element 116 in FIG. 4) located on the outer surface of the second electric insulation layer 114 because of its ability to effectively reduce an electric field radiated from the heating element 120 to an external field.

Figure 9:
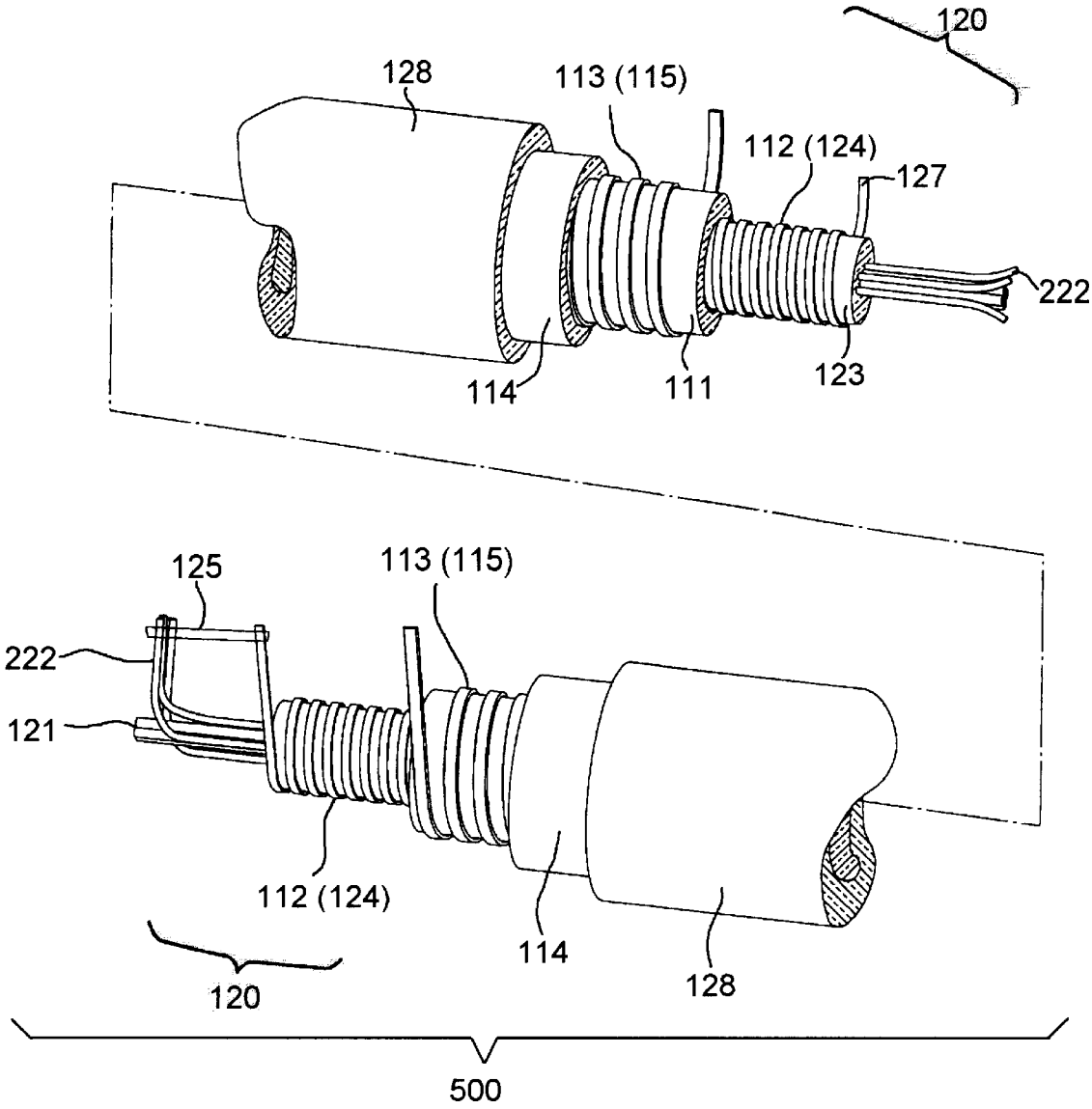
FIG. 9 illustrates a partly broken perspective view showing a thermo-sensitive heater according to a fifth embodiment of the present invention.

FIG. 9 is a partly broken perspective view showing a thermo-sensitive heater 500 according to a fifth embodiment of the present invention. The first heating coil 122 that is wound around the entire surfaces of the core wire 121 in FIG. 4 is replaced by a plurality of wires 222 that surrounds the surface of the core wire 121, as shown in FIG. 9. Acting as a heating coil, the plurality of wires 222 generates an electric field such that a need for a first shielding coil (as depicted by element 116 in FIG. 4) located on the outer surface of the second electric insulation layer 114 is eliminated. In addition, the heating coil 124 or the shielding coil 115 could be substituted by a wire mesh, as exemplified in FIGS. 7 and 8, to further shield from electric fields generated by the heater.

The heaters shown in FIGS. 7 to 9 may also be used with the driving circuits shown in FIGS. 2, 3 and 6.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A thermo-sensitive heater comprising:

a tubular coating layer with electric insulating characteristics;

a tubular thermistor disposed in the coating layer, having inner and outer surfaces;

a cord-shaped heating element disposed in the thermistor, having inner and outer surfaces;

a center core structure disposed in the form of a wire in the cord-shaped heating element;

a shielding coil disposed in the form of a winding wire around the outer surface of the thermistor, wherein the shielding coil comprises a temperature detecting terminal;

a first heating coil disposed in the form of a winding wire around the outer surface of the cord-shaped heating element, thus contacting the inner surface of the thermistor; and a second heating coil disposed in the form of a winding wire around the center core structure, contacting the inner surface of the cord-shaped heating element, wherein the first and second heating coils are connected in series and are each connected to a current supplying terminal.

2. The thermo-sensitive heater as set forth in claim 1, wherein the thermistor is formed on an outer surface of the cord-shaped heating element through an extrusion forming process.

3. The thermo-sensitive heater as set forth in claim 1, wherein the tubular coating layer comprises polyvinyl chloride.

4. The thermo-sensitive heater as set forth in claim 1, wherein the thermistor comprises a nylon resin.

5. The thermo-sensitive heater as set forth in claim 1, wherein the shielding coil comprises rolled copper wire that is formed by compressing a copper wire, and radiates electromagnetic waves radiated from the cord-shaped heating element to a neutral terminal of an AC voltage during a heating cycle.

6. The thermo-sensitive heater as set forth in claim 1, wherein the outer surface of the cord-shaped heating element comprises silicon rubber.

7. The thermo-sensitive heater as set forth in claim 1, wherein the center core structure comprises polyester filament yarn.

8. The thermo-sensitive heater as set forth in claim 1, wherein the first and second heating coils comprise rolled copper wire that is formed by compressing the copper wire.

9. The thermo-sensitive heater as set forth in claim 1, further comprising:

a diode disposed between a first terminal and the cord-shaped heating element such that an operation cycle of an AC voltage supplied to the first terminal and a neutral terminal is divided into a heating cycle with a positive AC voltage applied to the cord-shaped heating element through the first terminal, and a (2) temperature detecting cycle with the positive AC voltage applied to the current supplying terminal through the neutral terminal;

a heating resistor arranged parallel to the diode for inducing a temperature voltage left in the tubular thermistor to the temperature detecting terminal during a temperature detecting cycle; and a temperature controller for detecting a voltage, which is outputted between opposite sides of the heating resistor, through the temperature detecting terminal during the temperature detecting cycle, and for switching on/off a driving current for the cord-shaped heating element.

10. The thermo-sensitive heater as set forth in claim 9, wherein the temperature controller comprises:

a silicon controlled rectifier arranged between the first heating coil and the neutral terminal so as to switch on/off the driving current for the first and second heating coils which is applied through the first terminal;

a temperature fuse connected to the heating resistor and arranged on a side of a terminal for supplying the driving current for the cord-shaped heating element such that the temperature fuse is cut if a temperature of the heating resistor rises;

a temperature detector for detecting a temperature voltage applied between the heating resistor and the second heating coil during the temperature detecting cycle and for maintaining the detected temperature voltage until a next temperature detecting cycle;

a temperature setting unit for setting a heating temperature of the thermo-sensitive heater by a variable resistor and simultaneously operating in conjunction with a switch for switching on/off the driving current for the cord-shaped heating element;

a temperature comparator for comparing a temperature detected by the temperature detector and a temperature preset by the temperature setting unit, and for outputting a "high" signal if the detected temperature voltage is correspondingly lower than the preset temperature and a "low" signal if the detected temperature voltage is correspondingly higher than the preset temperature;

a zero detector for generating a "high" signal for a predetermined period of time when a voltage at the neutral terminal is 0 V during the operation cycle of the AC voltage, and for generating a "low" signal during a remaining period of time during the operation cycle of the AC voltage;

a disconnection detector connected to a side of the shielding coil opposite the neutral terminal for generating a "high" signal if the shielding coil is not disconnected, and for generating a "low" signal if the shielding coil is disconnected;

an AND gate for logically combining the output signals from the zero detector, the temperature comparator and the disconnection detector, and for outputting the combined signal; and a driving unit for receiving and amplifying the output of the combined signals from the AND gate and providing the amplified output of the combined signals to the SCR as a gate current.

11. A thermo-sensitive heater comprising:

a tubular coating layer with electric insulating characteristics;

a tubular electrical insulation layer disposed in the coating layer, having inner and outer surfaces;

a tubular first layer disposed in the electrical insulation layer, having inner and outer surfaces;

a cord-shaped heating element disposed in the first layer, having inner and outer surfaces;

a core wire disposed in the cord-shaped heating element;

a first electrode disposed around the outer surface of the cord-shaped heating element and connected to a driving current connection terminal, thus contacting the inner surface of the first layer, for applying a temperature measuring current to the first layer, and for use as a heating element of the cord-shaped heating element;

a second electrode disposed around the first layer, thus contacting the inner surface of the electrical insulation layer, for detecting an electric resistance value of the first layer, which is varied according to the temperature variation of the cord-shaped heating element; and a first heating coil disposed around the core wire and connected to a driving current connection terminal, wherein the first heating coil and the first electrode are connected in series.

12. The thermo-sensitive heater as set forth in claim 11, wherein a first shielding coil is disposed in the form of a winding wire around the outer surface of the electrical insulation layer for discharging an electric field radiated from the cord-shaped heating element to an external electric field and comprises rolled copper wire that is formed by compressing a copper wire.

13. The thermo-sensitive heater as set forth in claim 11, wherein the first electrode is a winding wire arranged to coil around the outer surface of the cord-shaped heating element and comprises rolled copper wire that is formed by compressing a copper wire.

14. The thermo-sensitive heater as set forth in claim 11, wherein the second electrode is a winding wire arranged to coil around the nylon layer and comprises rolled copper wire that is formed by compressing a copper wire.

15. The thermo-sensitive heater as set forth in claim 11, wherein the first heating coil is a winding wire arranged to coil around the electric insulation core wire and comprises rolled copper wire that is formed by compressing a copper wire.

16. The thermo-sensitive heater as set forth in claim 11, wherein the core wire comprises glass fiber wire.

17. The thermo-sensitive heater as set forth in claim 11, wherein the electrical insulation layer comprises silicon rubber.

18. The thermo-sensitive heater as set forth in claim 11, wherein the first layer comprises a nylon resin.

19. The thermo-sensitive heater as set forth in claim 11, wherein the outer surface of the cord-shaped heating element comprises rubber.

20. The thermo-sensitive heater as set forth in claim 11, wherein the tubular coating layer comprises polyvinyl chloride.

21. The thermo-sensitive heater as set forth in claim 11, wherein the first electrode is disposed in the form of a wire mesh surrounding the outer surface of the cord-shaped heating element.

22. The thermo-sensitive heater as set forth in claim 11, wherein the second electrode is disposed in the form of a wire mesh surrounding the first layer.

23. The thermo-sensitive heater as set forth in claim 11, wherein the first heating coil is disposed as a plurality of wires winding wire surrounding the core wire.

24. The thermo-sensitive heater as set forth in claim 11, wherein the cord-shaped heating element is a non-magnetic heating element;

the first electrode is used as a second heating coil; and the second electrode is used as a second shielding coil.

* * * * *